US011483664B2

(12) United States Patent
Harvey et al.

(10) Patent No.: US 11,483,664 B2
(45) Date of Patent: Oct. 25, 2022

(54) METHODS, APPARATUS AND SYSTEMS FOR BIOMETRIC PROCESSES

(71) Applicant: Cirrus Logic International Semiconductor Ltd., Edinburgh (GB)

(72) Inventors: Thomas Ivan Harvey, Edinburgh (GB); Vitaliy Sapozhnykov, Edinburgh (GB)

(73) Assignee: Cirrus Logic, Inc., Austin, TX (US)

( * ) Notice: Subject to any disclaimer, the term of this patent is extended or adjusted under 35 U.S.C. 154(b) by 0 days.

(21) Appl. No.: 16/834,578

(22) Filed: Mar. 30, 2020

(65) Prior Publication Data

US 2020/0344558 A1 Oct. 29, 2020

Related U.S. Application Data

(60) Provisional application No. 62/839,902, filed on Apr. 29, 2019, provisional application No. 62/839,957, filed on Apr. 29, 2019.

(51) Int. Cl.
*H04R 25/00* (2006.01)
*H04R 1/10* (2006.01)

(52) U.S. Cl.
CPC ..... *H04R 25/402* (2013.01); *H04R 1/1083* (2013.01); *H04R 25/48* (2013.01); *H04R 2225/39* (2013.01); *H04R 2225/41* (2013.01); *H04R 2410/05* (2013.01)

(58) Field of Classification Search
CPC ..... G06F 21/32; G06F 21/31; G07C 9/37; A61B 5/117; G06K 9/00885; G10L 17/00
See application file for complete search history.

(56) References Cited

U.S. PATENT DOCUMENTS

| | | | |
|---|---|---|---|
| 5,787,187 | A | 7/1998 | Bouchard et al. |
| 2008/0262382 | A1 | 10/2008 | Akkermans et al. |
| 2009/0061819 | A1 | 3/2009 | Coughlan et al. |
| 2017/0214997 | A1 | 1/2017 | Kaller et al. |
| 2018/0376234 | A1 | 12/2018 | Petrank |
| 2019/0012445 | A1 | 1/2019 | Lesso et al. |
| 2019/0012446 | A1 | 1/2019 | Lesso |
| 2019/0095653 | A1 | 3/2019 | Kurosawa |
| 2019/0189129 | A1 | 6/2019 | Arakawa et al. |
| 2021/0103646 | A1 | 4/2021 | Koshinaka et al. |

FOREIGN PATENT DOCUMENTS

| | | | |
|---|---|---|---|
| WO | 2006054205 | A1 | 5/2006 |
| WO | 2018213746 | A1 | 11/2018 |
| WO | 2020044019 | A1 | 3/2020 |

OTHER PUBLICATIONS

Combined Search and Examination Report under Sections 17 and 18(3), UKIPO, Application No. GB1908804.6, dated Dec. 11, 2019.

(Continued)

*Primary Examiner* — Kile O Blair
(74) *Attorney, Agent, or Firm* — Jackson Walker L.L.P.

(57) ABSTRACT

A method for masking an acoustic stimulus, comprising: detecting an event initiated by a user of a personal audio device, the event having an associated audio artefact; in response to detecting the event, applying the acoustic stimulus to the user's ear during a masking period in which the acoustic stimulus is masked in the user's hearing by the audio artefact; extracting, from a response signal of the user's ear to the acoustic stimulus, one or more features for use in a biometric process.

16 Claims, 8 Drawing Sheets

(56) References Cited

OTHER PUBLICATIONS

Combined Search and Examination Report under Sections 17 and 18(3), UKIPO, Application No. GB1908797.2, dated Nov. 14, 2019.
Combined Search and Examination Report under Sections 17 and 18(3), UKIPO, Application No. GB1908803.8, dated Dec. 11, 2019.
Combined Search and Examination Report under Sections 17 and 18(3), UKIPO, Application No. GB1908799.8, dated Nov. 20, 2019.
Examination Report under Section 18(3), UKIPO, Application No. GB1908804.6, dated Aug. 19, 2021.

METHODS, APPARATUS AND SYSTEMS FOR BIOMETRIC PROCESSES

The present disclosure claims priority to U.S. Provisional Patent Application Ser. No. 62/839,902, filed Apr. 29, 2019, and U.S. Provisional Patent Application Ser. No. 62/839,957, filed Apr. 29, 2019, each of which is incorporated by reference herein in its entirety.

TECHNICAL FIELD

Embodiments of the disclosure relate to methods, apparatus and systems for biometric processes, and particularly to methods, apparatus and systems for biometric processes involving the measured response of a user's ear to an acoustic stimulus.

BACKGROUND

It is known that the acoustic properties of a user's ear, whether the outer parts (known as the pinna or auricle), the ear canal or both, differ substantially between individuals and can therefore be used as a biometric to identify the user. One or more loudspeakers or similar transducers positioned close to or within the ear generate an acoustic stimulus, and one or more microphones similarly positioned close to or within the ear detect the acoustic response of the ear to the acoustic stimulus. One or more features may be extracted from the response signal, and used to characterize an individual.

For example, the ear canal is a resonant system, and therefore one feature which may be extracted from the response signal is the resonant frequency of the ear canal. If the measured resonant frequency (i.e. in the response signal) differs from a stored resonant frequency for the user, a biometric algorithm coupled to receive and analyse the response signal may return a negative result. Other features of the response signal may be similarly extracted and used to characterize the individual. For example, the features may comprise one or more mel frequency cepstral coefficients. More generally, the transfer function between the acoustic stimulus and the measured response signal (or features of the transfer function) may be determined, and compared to a stored transfer function (or stored features of the transfer function) which is characteristic of the user.

A problem associated with ear biometric systems is that the signal to noise ratio of the measured response signal from the user's ear is typically quite low as the biometric features of the signal are relatively weak. This problem can be exacerbated depending on a number of factors. For example, the acoustic signal used to generate the measured response tends to have a narrow bandwidth and low amplitude so as not to be overbearing on the user. For example, the user may be present in a noisy environment. For example, earphones used to acquire the ear biometric data may be poorly fitted to the user's ear (e.g. inserted too far into the user's ear, or not sufficiently inserted).

Any discussion of documents, acts, materials, devices, articles or the like which has been included in the present specification is not to be taken as an admission that any or all of these matters form part of the prior art base or were common general knowledge in the field relevant to the present disclosure as it existed before the priority date of each of the appended claims.

SUMMARY

A method for masking an acoustic stimulus, comprising: detecting an event initiated by a user of a personal audio device, the event having an associated audio artefact; in response to detecting the event, applying the acoustic stimulus to the user's ear during a masking period in which the acoustic stimulus is masked in the user's hearing or at the user's eardrum by the audio artefact; extracting, from a response signal of the user's ear to the acoustic stimulus, one or more features for use in a biometric process.

The event may be a user interaction by the user with the personal audio device. The user interaction may be a physical interaction with the personal audio device. The physical interaction may comprise tapping the personal audio device interacting with a button on the personal audio device.

The event may be detected using one or more of an accelerometer, a button, a microphone, or a transducer of the personal audio device.

The event may comprise a voice interaction between the user and the personal audio device. Alternatively, the event may be the user speaking but not to interact with the personal audio device. Alternatively, the event may be the user chewing or masticating, again not to interact with the personal audio device. Voice and/or chewing may be detected using a voice activity detector (VAD) of the acoustic device or one or microphones or one or more transducers which may or may not form part of the personal audio device. Alternatively, the event may comprise a heartbeat of the user. Alternatively, the event may comprise a footfall or a footstep of the user.

The method may further comprise generating the acoustic stimulus for application to the user's ear.

The method may further comprise: determining one or more properties of the audio artefact. The acoustic stimulus may be generated in dependence on the one or more properties of the audio artefact. The one or more properties may comprise one or more of a frequency response and an amplitude of the audio artefact. The one or more properties may comprise one or more of a peak amplitude or frequency response, an average amplitude or frequency response, a resonance, a duration, an attack rate, a decay rate, or an acceleration or force applied to the headset. Generating the acoustic stimulus based on the one or more properties of the audio artefact may comprises one or more of: modifying the gain of the acoustic stimulus, increasing the duration of the acoustic stimulus, applying an additional instance of the acoustic stimulus, shifting the pitch of the acoustic stimulus such that content of the response signal is better aligned with one or more resonances of the user's ear, adding a masking noise to the acoustic stimulus, amplifying ambient noise and/or user voice via hear through mode or sidetone path, using a masking model to add additional content to the acoustic stimulus that is inaudible to the user, and adding harmonic content to the acoustic stimulus.

Detecting the event initiated by the user may comprise predicting the event based on two or more historic user initiated events, each historic user initiated event having an associated historic audio artefact. For example, the event may be a heartbeat of the user and the historic events may be previous heartbeats of the user. For example, the event may be a footstep or footfall of the user and the historic events may be previous footsteps or footfalls of the user.

The masking period may at least partially coincide with the audio artefact. For example, the masking period may partly or fully coincide with a decay envelope of the audio artefact.

The method may further comprise performing the biometric process. The biometric process may be one of on-ear detection, in-ear detection, biometric enrolment and biometric authentication. Biometric enrolment may comprise generating and storing a unique model for the user based on the one or more features. Biometric authentication may comprise comparing the one or more features to a unique model for the user. In- or on-ear detection may comprise comparing the one or more features to a generic model for a human user.

The acoustic stimulus may be applied to the user's ear by a transducer of the personal audio device.

The method may further comprise detecting the response signal at a microphone of the personal audio device.

According to another aspect of the disclosure, there is provided an apparatus, comprising processing circuitry and a non-transitory machine-readable which, when executed by the processing circuitry, cause the apparatus to: detect an event initiated by a user of a personal audio device, the event having an associated audio artefact; in response to detection of the event, apply an acoustic stimulus to a user's ear using the transducer during a masking period in which the acoustic stimulus is masked in the user's hearing or at the user's eardrum by the audio artefact; and extract, from a response signal of the user's ear to the acoustic stimulus detected by the microphone, one or more features for use in a biometric process.

The apparatus may comprise a transducer configured to apply the acoustic stimulus; and a microphone configured to detect the response signal of the user's ear. The microphone may be further configured to detect an error signal for use in an active noise cancellation system. Alternatively, the apparatus may comprise: a transducer configured to: apply the acoustic stimulus; and detect the response signal of the user's ear.

The event may be a user interaction by the user with the personal audio device. The user interaction may be a physical interaction with the personal audio device. The physical interaction may comprise tapping the personal audio device interacting with a button on the personal audio device.

The event may be detected using one or more of an accelerometer, a button, a microphone, or a transducer each of which may be comprised by the personal audio device.

The event may comprise a voice interaction between the user and the personal audio device. Alternatively, the event may be the user speaking but not to interact with the personal audio device. Alternatively, the event may be the user chewing or masticating, again not to interact with the personal audio device. Voice and/or chewing may be detected using a voice activity detector (VAD) of the acoustic device or one or microphones or one or more transducers which may or may not form part of the personal audio device.

The processing circuitry may further cause the apparatus to determine one or more properties of the audio artefact. The acoustic stimulus may be generated in dependence on the one or more properties of the audio artefact. The one or more properties may comprise one or more of a frequency response and an amplitude of the audio artefact. The one or more properties may comprise one or more of a peak amplitude or frequency response, an average amplitude or frequency response, a resonance, a duration, an attack rate, a decay rate, or an acceleration or force applied to the headset.

The processing circuitry may further cause the apparatus to generate the acoustic stimulus for application to the user's ear.

The processing circuitry may further cause the apparatus to perform the biometric process. The biometric process may be one of on-ear detection, in-ear detection, biometric enrolment and biometric authentication. Biometric enrolment may comprise generating and storing a unique model for the user based on the one or more features. Biometric authentication may comprise comparing the one or more features to a unique model for the user. In- or on-ear detection may comprise comparing the one or more features to a generic model for a human user.

The acoustic stimulus may be applied to the user's ear by a transducer of the personal audio device.

The processing circuitry may further cause the apparatus to detect the response signal at the microphone or transducer of the personal audio device.

According to another aspect of the disclosure, there is provided an apparatus, comprising processing circuitry and a non-transitory machine-readable which, when executed by the processing circuitry, cause the apparatus to: detect an event initiated by a user of a personal audio device, the event having an associated audio artefact; in response to detection of the event, apply an acoustic stimulus to a user's ear using the transducer during at least part of a decay envelope of the audio artefact associated with the event; and extract, from a response signal of the user's ear to the acoustic stimulus detected by the microphone, one or more features for use in a biometric process.

According to another aspect of the disclosure, there is provided an electronic device, comprising the apparatus described above.

According to another aspect of the disclosure, there is provided a non-transitory machine-readable medium storing instructions which, when executed by one or more processors, cause an electronic apparatus to: detect an event initiated by a user, the event having an associated audio artefact; in response to detecting the event, applying an acoustic stimulus to the user's ear during a masking period in which the acoustic stimulus is masked in the user's hearing or at the user's eardrum by the audio artefact; extracting, from a response signal of the user's ear to the acoustic stimulus, one or more features for use in a biometric process.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

BRIEF DESCRIPTION OF DRAWINGS

Embodiments of the present disclosure will now be described by way of non-limiting example only with reference to the accompanying drawings, in which.

DESCRIPTION OF EMBODIMENTS

As noted above, ear biometric data may be acquired by the generation of an acoustic stimulus, and the detection of an acoustic response of the ear to the acoustic stimulus. One or more features may be extracted from the response signal, and used to characterize the individual.

The acoustic stimulus may be generated and the response measured using a personal audio device. As used herein, the term "personal audio device" is any electronic device which is suitable for, or configurable to, provide audio playback substantially to only a single user. Some examples of suitable personal audio devices are shown in FIGS. 1*a* to 1*e*.

Figure 1A:
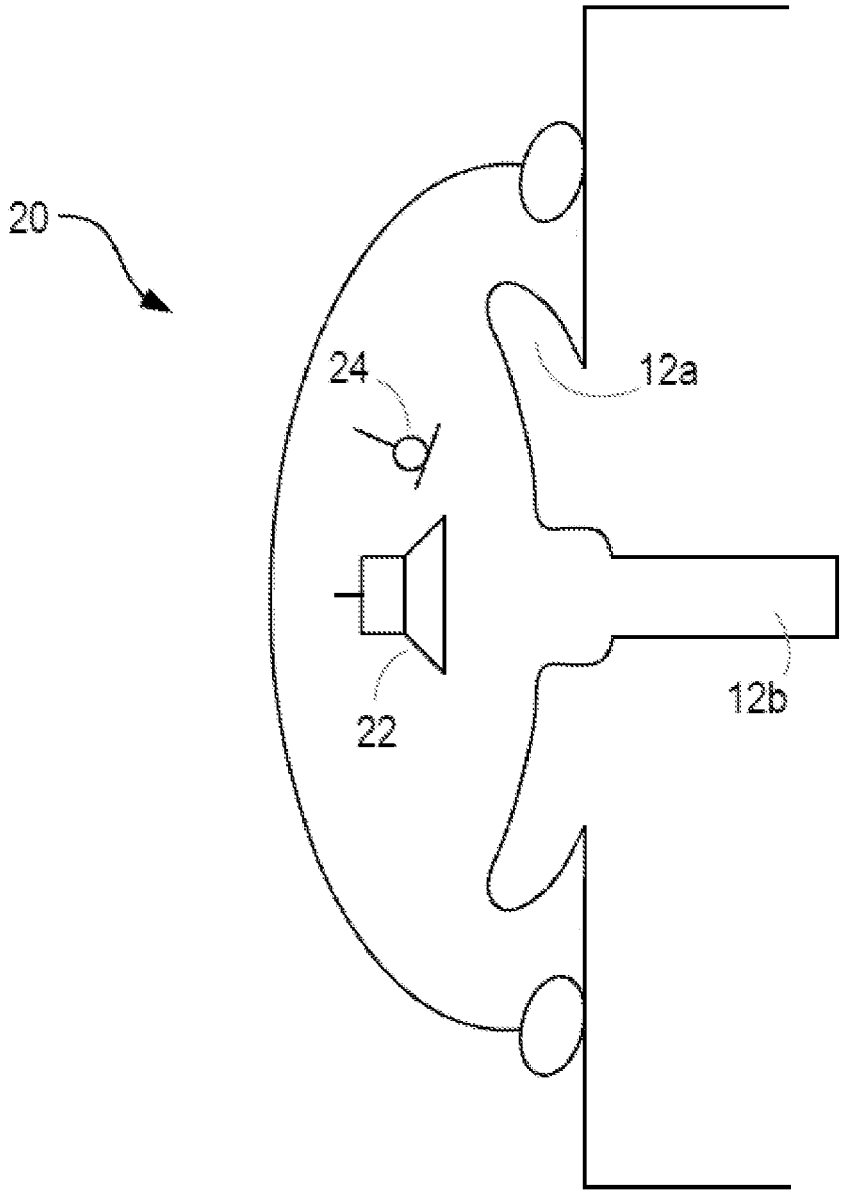
FIGS. 1*a* to 1*e* are schematic diagrams of example personal audio devices.

FIG. 1*a* shows a schematic diagram of a user's ear, comprising the (external) pinna or auricle 12*a*, and the (internal) ear canal 12*b*. A personal audio device 20 comprising a circum-aural headphone is worn by the user over the ear. The headphone comprises a shell which substantially surrounds and encloses the auricle 12*a*, so as to provide a physical barrier between the user's ear and the external environment. Cushioning or padding may be provided at an edge of the shell, so as to increase the comfort of the user, and also the acoustic coupling between the headphone and the user's skin (i.e. to provide a more effective barrier between the external environment and the user's ear).

The headphone comprises one or more loudspeakers 22 positioned on an internal surface of the headphone, and arranged to generate acoustic signals towards the user's ear and particularly the ear canal 12*b*. The headphone further comprises one or more microphones 24, also positioned on the internal surface of the headphone, arranged to detect acoustic signals within the internal volume defined by the headphone, the auricle 12*a* and the ear canal 12*b*.

The headphone may be able to perform active noise cancellation, to reduce the amount of noise experienced by the user of the headphone. Active noise cancellation operates by detecting a noise (i.e. with a microphone), and generating a signal (i.e. with a loudspeaker) that has the same amplitude as the noise signal but is opposite in phase. The generated signal thus interferes destructively with the noise and so lessens the noise experienced by the user. Active noise cancellation may operate on the basis of feedback signals, feedforward signals, or a combination of both. Feedforward active noise cancellation utilizes one or more microphones on an external surface of the headphone, operative to detect the environmental noise before it reaches the user's ear. The detected noise is processed quickly, and the cancellation signal generated so as to match the incoming noise as it arrives at the user's ear. Feedback active noise cancellation utilizes one or more error microphones positioned on the internal surface of the headphone, operative to detect the combination of the noise and the audio playback signal generated by the one or more loudspeakers. This combination is used in a feedback loop, together with knowledge of the audio playback signal, to adjust the cancelling signal generated by the loudspeaker and so reduce the noise. The microphone 24 shown in FIG. 1*a* may therefore form part of an active noise cancellation system, for example, as an error microphone.

Figure 1B:
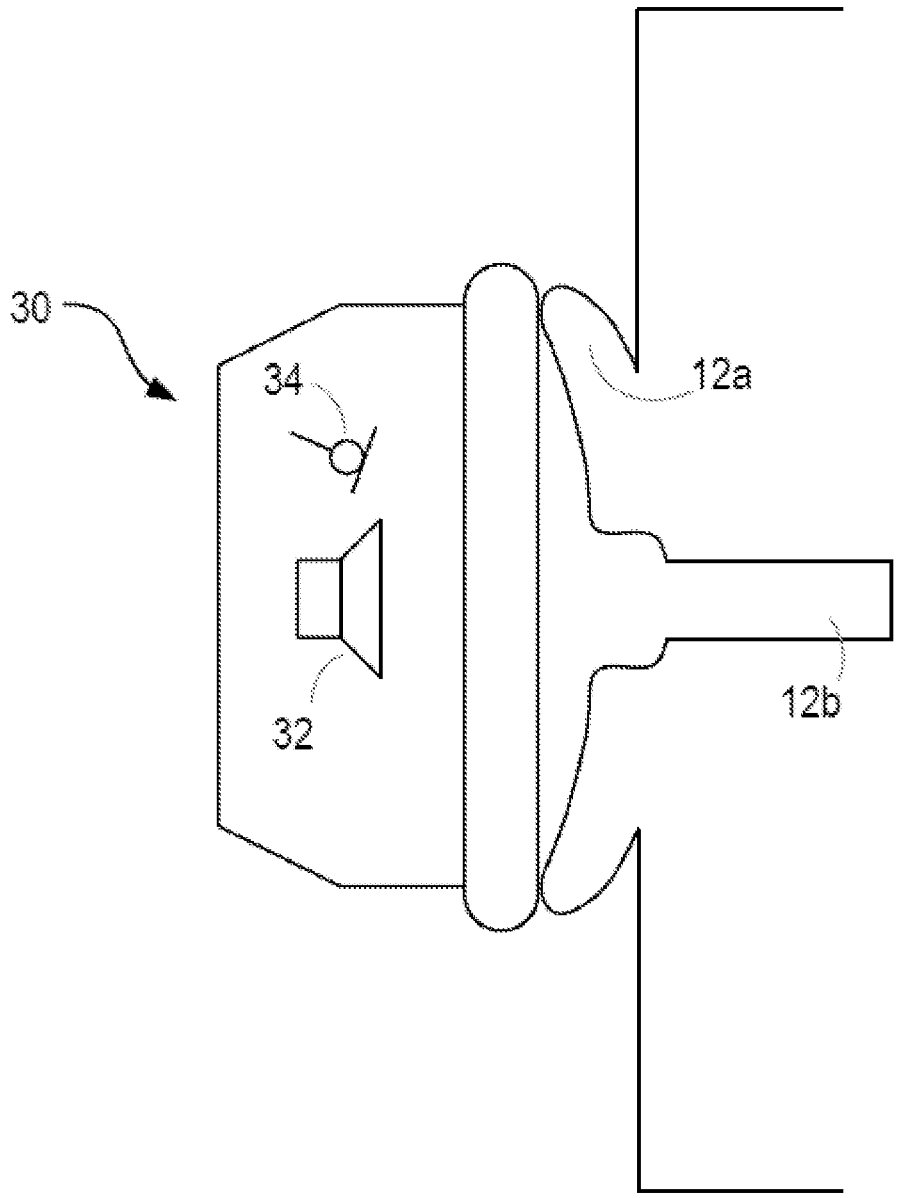

FIG. 1*b* shows an alternative personal audio device 30, comprising a supra-aural headphone. The supra-aural headphone does not surround or enclose the user's ear, but rather sits on the auricle 12*a*. The headphone may comprise a cushion or padding to lessen the impact of environmental noise. As with the circum-aural headphone shown in FIG. 1*a*, the supra-aural headphone comprises one or more loudspeakers 32 and one or more microphones 34. The loudspeaker(s) 32 and the microphone(s) 34 may form part of an active noise cancellation system, with the microphone 34 serving as an error microphone.

Figure 1C:
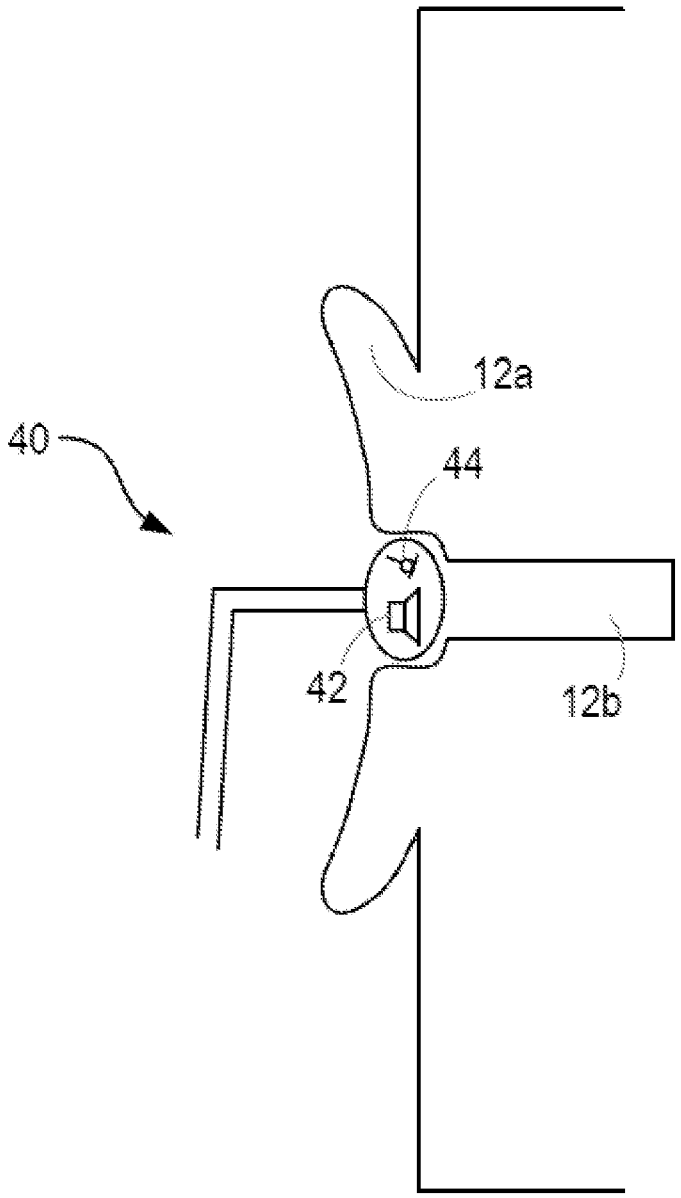

FIG. 1*c* shows a further alternative personal audio device 40, comprising an intra-concha headphone (or earphone). In use, the intra-concha headphone sits inside the user's concha cavity. The intra-concha headphone may fit loosely within the cavity, allowing the flow of air into and out of the user's ear canal 12*b*.

As with the devices shown in FIGS. 1*a* and 1*b*, the intra-concha headphone comprises one or more loudspeakers 42 and one or more microphones 44, which may form part of an active noise cancellation system.

Figure 1D:
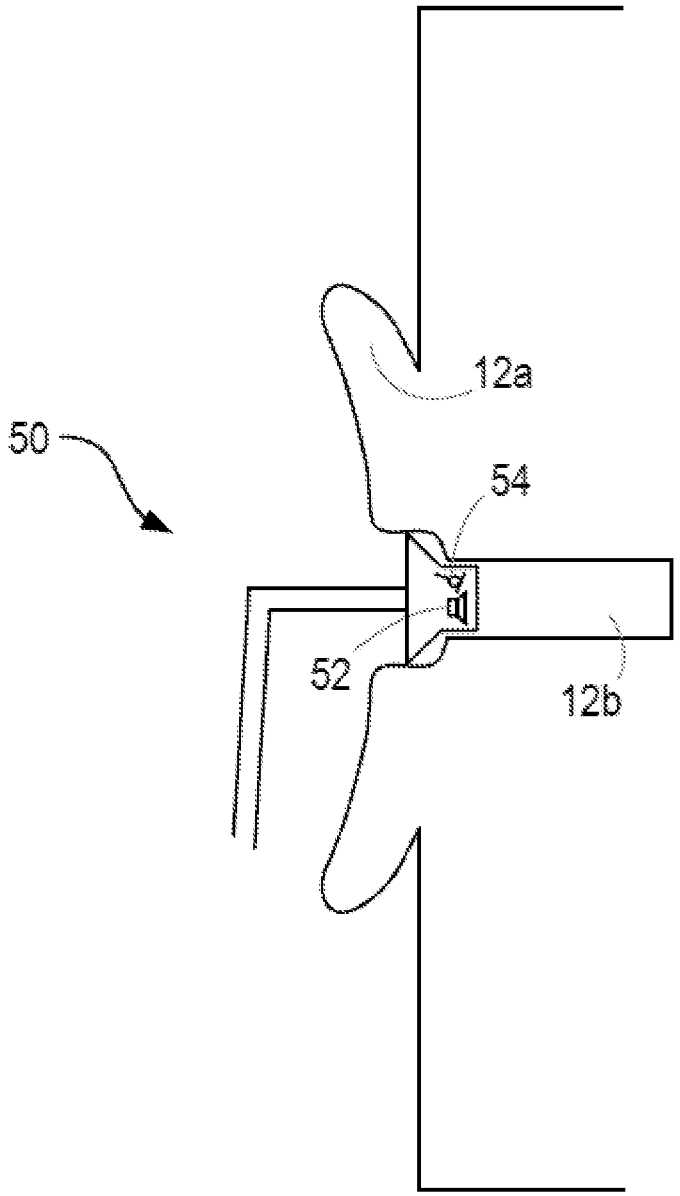

FIG. 1*d* shows a further alternative personal audio device 50, comprising an in-ear headphone (or earphone), insert headphone, or earbud. This headphone is configured to be partially or totally inserted within the ear canal 12*b*, and may provide a relatively tight seal between the ear canal 12*b* and the external environment (i.e. it may be acoustically closed or sealed). The headphone may comprise one or more loudspeakers 52 and one or more microphones 54, as with the others devices described above, and these components may form part of an active noise cancellation system.

As the in-ear headphone may provide a relatively tight acoustic seal around the ear canal 12*b*, external noise (i.e. coming from the environment outside) detected by the microphone 54 is likely to be low.

Figure 1E:
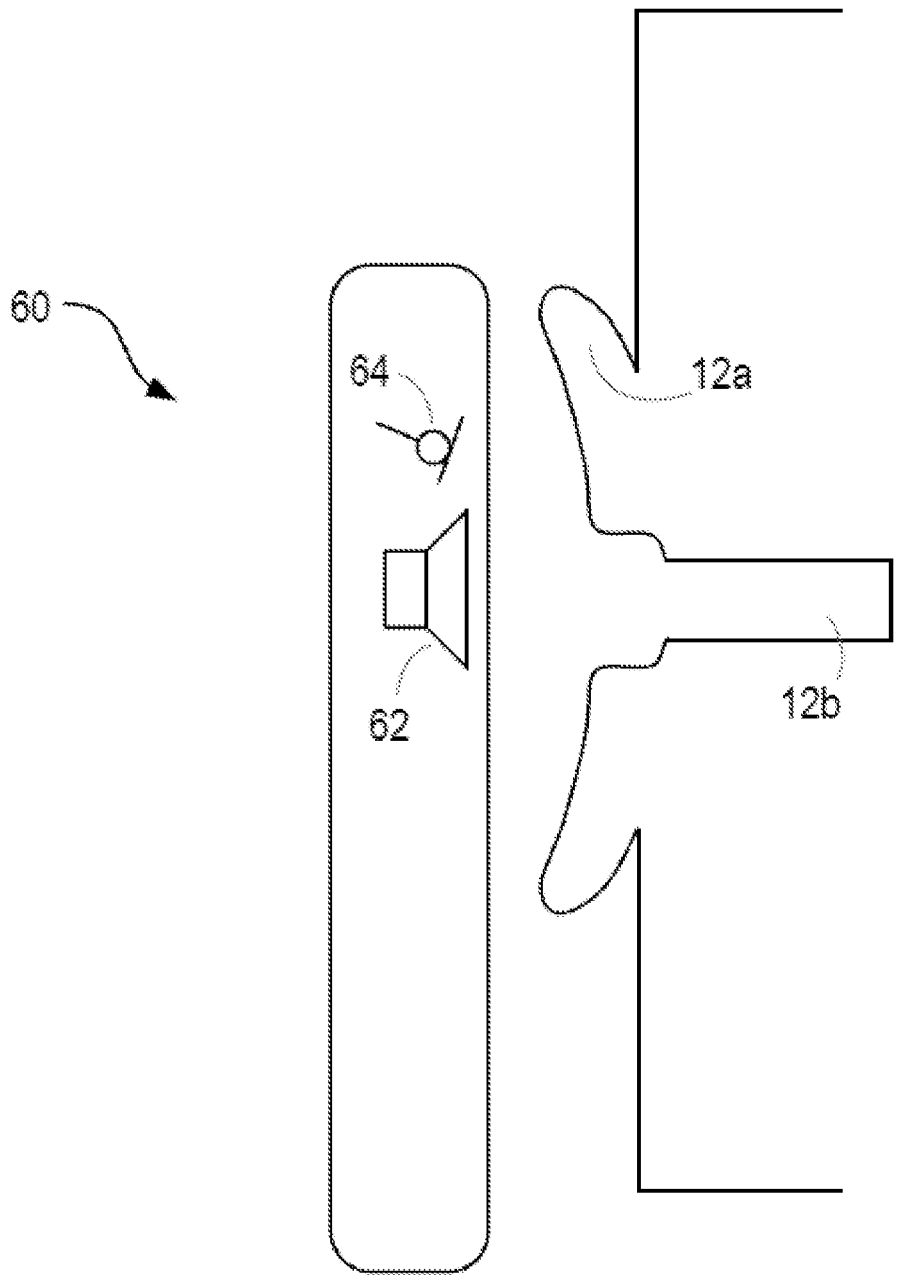

FIG. 1*e* shows a further alternative personal audio device 60, which is a mobile or cellular phone or handset. The handset 60 comprises one or more loudspeakers 62 for audio playback to the user, and one or more microphones 64 which are similarly positioned.

In use, the handset 60 is held close to the user's ear so as to provide audio playback (e.g. during a call). While a tight acoustic seal is not achieved between the handset 60 and the user's ear, the handset 60 is typically held close enough that an acoustic stimulus applied to the ear via the one or more loudspeakers 62 generates a response from the ear which can be detected by the one or more microphones 64. As with the other devices, the loudspeaker(s) 62 and microphone(s) 64 may form part of an active noise cancellation system.

All of the personal audio devices described above thus provide audio playback to substantially a single user in use. Each device comprises one or more loudspeakers and one or more microphones, which may be utilized to generate biometric data related to the frequency response of the user's ear. The loudspeaker is operable to generate an acoustic stimulus, or acoustic probing wave, towards the user's ear, and the microphone is operable to detect and measure a response of the user's ear to the acoustic stimulus, e.g. to measure acoustic waves reflected from the ear canal or the pinna. The acoustic stimulus may be sonic (for example in the audio frequency range of say 20 Hz to 20 kHz) or ultra-sonic (for example greater than 20 kHz or in the range 20 kHz to 50 kHz) or near-ultrasonic (for example in the range 15 kHz to 25 kHz) in frequency. The acoustic stimulus may have frequency components which span one or more of sonic, ultra-sonic, and near-ultrasonic ranges. In some examples the microphone signal may be processed to measure received signals of the same frequency as that transmitted.

Each of the personal audio devices described above comprises one or more loudspeakers in addition to one or more microphones. However, in some embodiments, the one or more speakers may be used both to generate an acoustic stimulus and as an input device to detect and measure a response of the user's ear to the acoustic stimulus, e.g. to measure acoustic waves reflected from the ear canal or the pinna. For example, the response of the user's ear may be measured by measuring current induced by the loudspeaker or transducer. In such cases, the one or more microphones may be omitted.

Another biometric marker may comprise otoacoustic noises emitted by the cochlear in response to the acoustic stimulus waveform. The otoacoustic response may comprise a mix of the frequencies in the input waveform. For example if the input acoustic stimulus consists of two tones at frequencies f1 and f2, the otoacoustic emission may include a component at frequency 2*f1−f2. The relative power of frequency components of the emitted waveform has been shown to be a useful biometric indicator. In some examples therefore the acoustic stimulus may comprise tones of two or more frequencies and the amplitude of mixing products at sums or differences of integer-multiple frequencies generated by otoacoustic emissions from the cochlear may be measured. Alternatively, otoacoustic emissions may be stimulated and measured by using stimulus waveforms comprising fast transients, e.g. clicks.

Depending on the construction and usage of the personal audio device, the measured response may comprise user-specific components, i.e. biometric data relating to the auricle 12*a*, the ear canal 12*b*, or a combination of both the auricle 12*a* and the ear canal 12*b*. For example, the circumaural headphones shown in FIG. 1*a* will generally acquire data relating to the auricle 12*a* and potentially also the ear canal 12*b*. The insert headphones shown in FIG. 1*d* will generally acquire data relating only to the ear canal 12*b*.

One or more of the personal audio devices described above (or rather, the microphones within those devices) may be operable to detect bone-conducted voice signals from the user. That is, as the user speaks, sound is projected away from the user's mouth through the air. However, acoustic vibrations will also be carried through part of the user's skeleton or skull, such as the jaw bone. These acoustic vibrations may be coupled to the ear canal 12*b* through the jaw or some other part of the user's skeleton or skull, and detected by the microphone. Lower frequency sounds tend to experience a stronger coupling than higher frequency sounds, and voiced speech (i.e. that speech or those phonemes generated while the vocal cords are vibrating) is coupled more strongly via bone conduction than unvoiced speech (i.e. that speech or those phonemes generated while the vocal cords are not vibrating). The in-ear headphone 50 may be particularly suited to detecting bone-conducted speech owing to the tight acoustic coupling around the ear canal 12*b*.

All of the devices shown in FIGS. 1*a* to 1*e* and described above may be used to implement aspects of the disclosure.

Figure 2:
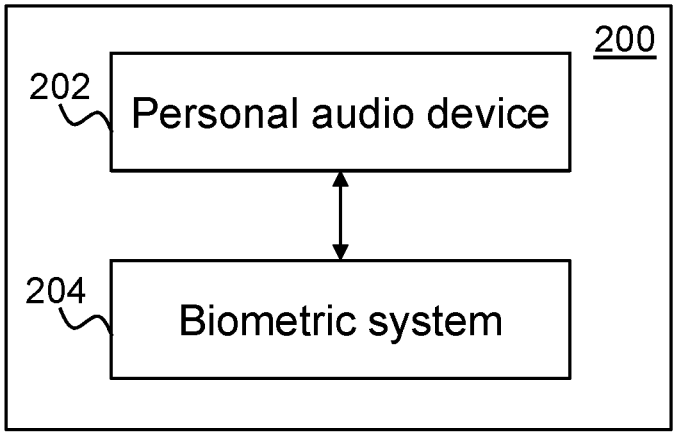
FIG. 2 is a block diagram of an arrangement according to embodiments of the present disclosure.

FIG. 2 shows an arrangement 200 according to embodiments of the disclosure. The arrangement 200 comprises a personal audio device 202 and a biometric system 204. The personal audio device 202 may be any device which is suitable for, or configurable to provide audio playback to substantially a single user. The personal audio device 202 generally comprises one or more loudspeakers, and one or more microphones which, in use, are positioned adjacent to or within a user's ear. The personal audio device 202 may be wearable, and comprise headphones for each of the user's ears. Alternatively, the personal audio device 202 may be operable to be carried by the user, and held adjacent to the user's ear or ears during use. The personal audio device 202 may comprise headphones or a mobile phone handset, as described above with respect to any of FIGS. 1*a* to 1*e*.

The biometric system 204 is coupled to the personal audio device 202 and operative to control the personal audio device 202 to acquire biometric data which is indicative of the individual using the personal audio device 202.

The personal audio device 202 thus generates an acoustic stimulus for application to the user's ear, and detects or measures the response of the ear to the acoustic stimulus. The measured response corresponds to the reflected signal received at the one or more microphones, with certain frequencies being reflected at higher amplitudes than other frequencies owing to the particular response of the user's ear.

Some examples of suitable biometric processes include detecting whether a personal audio device is on or in the ear of a user (on/in ear detection), biometric enrolment and biometric authentication. Biometric enrolment comprises the acquisition and storage of biometric data which is characteristic of an individual. In the present context, such stored data may be known as an "ear print". Authentication (sometimes referred to as verification or identification) comprises the acquisition of biometric data from an individual, and the comparison of that data to the stored ear prints of one or more enrolled or authorised users. A positive comparison (i.e. a determination that the acquired data matches or is sufficiently close to a stored ear print) results in the individual being authenticated. For example, the individual may be permitted to carry out a restricted action, or granted access to a restricted area or device. A negative comparison (i.e. a determination that the acquired data does not match or is not sufficiently close to a stored ear print) results in the individual not being authenticated. For example, the individual may not be permitted to carry out the restricted action, or granted access to the restricted area or device. On/in ear detection may comprise comparing data derived from the microphone of a device with stored ear prints to determine whether the signal received at the microphone is representative of any ear, as opposed to a particular ear in the case of biometric authentication.

The biometric system 204 may, in some embodiments, form part of the personal audio device 202 itself. Alternatively, the biometric system 204 may form part of an electronic host device (e.g. an audio player) to which the personal audio device 202 is coupled, through wires or wirelessly. In yet further embodiments, operations of the biometric system 204 may be distributed between circuitry in the personal audio device 202 and the electronic host device.

The biometric system 204 may send suitable control signals to the personal audio device 202, so as to initiate the acquisition of biometric data, and receive data from the personal audio device 202 corresponding to the measured response. The biometric system 204 is operable to extract one or more features from the measured response and utilize those features as part of a biometric process.

As mentioned previously, a problem associated with ear biometric systems is that the signal to noise ratio of the measured response signal is typically quite low as the biometric features of the signal are relatively weak. This problem can be exacerbated by the use of an acoustic signal having properties which minimize audibility to the user but also minimize response from the user's ear. Typically, the acoustic stimulus is preset, for example, to have a flat frequency spectrum over a relatively narrow frequency range and to have a low volume so as not to surprise or irritate the user of the personal audio device 202.

Embodiments of the present disclosure aim to improve the signal to noise ratio (SNR) of the measured response signal by delivering an acoustic stimulus during the decay envelope of audio artefacts associated with events initiated by users of the personal audio device 202. In doing so, the acoustic stimulus is masked by the audio artefact and can thus have a higher signal level and/or larger bandwidth, which in turn can improve the measured response signal.

In addition to improving SNR, embodiments of the present disclosure enable additional biometric events to be hidden in audio artefacts associated with interaction with the personal audio device 202. For example, the user may initiate a virtual assistant with a tap or double tap of the personal audio device 202 instead of using a voice trigger, such as "Hey Siri" or "Alexa". In which case, embodiments of the present disclosure may use this interaction to hide an acoustic stimulus. The hidden acoustic stimulus can be used to detect whether the personal audio device 202 is on or in the ear of a user and/or for authenticating the user as the user triggers the virtual assistant. In another example, the user may initiate the virtual assistant with a physical interaction or a voice command, and the virtual assistant may require further input. For example, the virtual assistant may ask the user a question, e.g. "Your water bill is available to payment would you like me to pay?" The user may then authenticate payment by physically interacting (through a tap or otherwise) with the personal audio device 202 and the physical interaction may then be used to embed an acoustic stimulus for authentication of the user. Again, the acoustic stimulus may also be used to determine whether the personal audio device 202 is in or on the ear.

In view of the above, according to embodiments of the disclosure, the biometric system 204 is further operable to detect an event initiated by a user, such as the user interaction between the user and the personal audio device 202, where the event or user interaction has an associated audio artefact which may be audible to the user. The user interaction may be a physical interaction between the user and the personal audio device 202, such as the user tapping the personal audio device 202 or pressing a button located on the personal audio device 202. The user interaction may be a voice interaction between the user and the personal audio device 202 such as a voice command which may be intended to be picked up at one or more microphones of the personal audio device 202. Such a voice command may be intended to initiate an exchange with a virtual assistant such as Apple® Siri® or Google® Alexa®. The event initiated by the user may be chewing or masticating, which may generate the audio artefact. The detection may equally be performed by the personal audio device 202 and the biometric system 204 may receive data pertaining to the user interaction.

Embodiments described below may refer specifically to embodiments in which the event is a user interaction. It will be appreciated, however, that embodiments of the present disclosure are not limited to the detection of user interactions only. On the contrary, detection of other, non-interactive events in which the user generates an audio artefact which is not associated with an interaction between the user and the personal audio device 202, also fall within the scope of the present disclosure. Such non-interactive events may include but are not limited to chewing, masticating, speaking, or singing.

Figure 3:
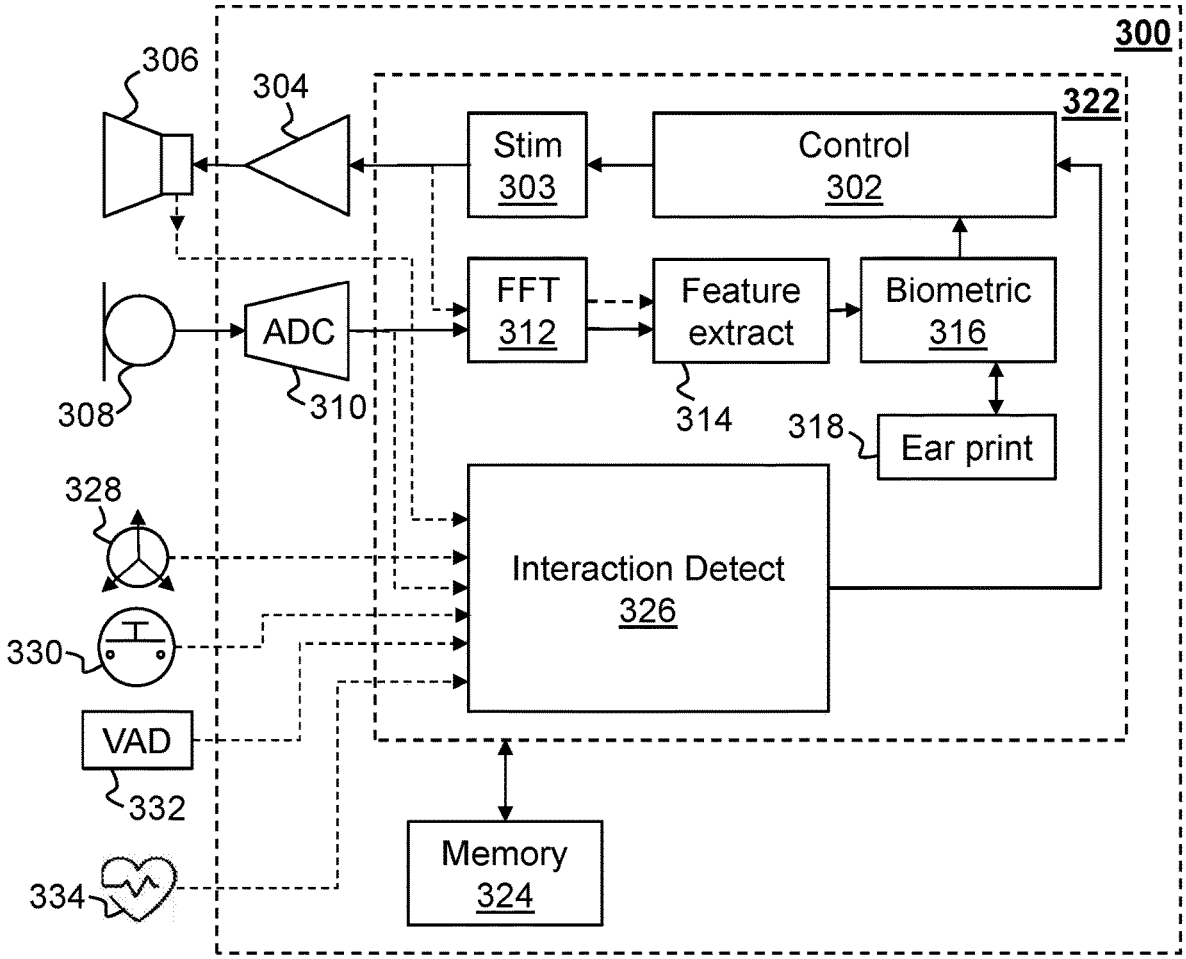
FIG. 3 is a block diagram of a system according to embodiments of the present disclosure.

FIG. 3 shows a system 300 according to embodiments of the disclosure.

The system 300 comprises processing circuitry 322, which may comprise one or more processors, such as a central processing unit or an applications processor (AP), or a digital signal processor (DSP).

The one or more processors may perform methods as described herein on the basis of data and program instructions stored in memory 324. Memory 324 may be provided as a single component or as multiple components or co-integrated with at least some of processing circuitry 322. Specifically, the methods described herein may be performed in processing circuitry 322 by executing instructions that are stored in non-transient form in the memory 324, with the program instructions being stored either during manufacture of the system 300 or personal audio device 202 or by upload while the system 300 or device 202 is in use.

The processing circuitry 322 comprises a stimulus generator module 303 which is coupled directly or indirectly to an amplifier 304, which in turn is coupled to a transducer 306.

The stimulus generator module 303 generates an electrical audio signal and provides the electrical audio signal to the amplifier 304, which amplifies it and provides the amplified signal to the transducer 306. The transducer 306 generates a corresponding acoustic signal which is output to the user's ear (or ears). In alternative embodiments, the amplifier 304 may form part of the stimulus generator module 303.

As noted above, the audio signal may be output to all or a part of the user's ear (i.e. the auricle 12*a* or the ear canal 12*b* of the user as described with reference to FIGS. 1*a* to 1*e*), provided the personal audio device 202 is in position on or in the ear. The audio signal is reflected off the ear, and the reflected signal (or echo signal) is detected and received by a microphone 308. The reflected signal thus comprises data which is characteristic of not only of an ear in general, but more specifically the individual's ear, and suitable for use as a biometric, which can be used for example to determine that the personal audio device 202 is in or on the user's ear or to determine a specific characteristic of the user's ear for use in biometric enrolment or authentication.

The reflected signal is passed from the microphone 308 to an analogue-to-digital converter (ADC) 310, where it is converted from the analogue domain to the digital domain. In alternative embodiments the microphone 308 may be a digital microphone and produce a digital data signal (which does not therefore require conversion to the digital domain).

The signal is detected by the microphone 308 in the time domain. However, the features extracted for the purposes of the biometric process may be in the frequency domain (in that it is the frequency response of the ear which is characteristic). In which case, the system 300 may comprise a Fourier transform module 312, which converts the reflected signal to the frequency domain. For example, the Fourier transform module 312 may implement a fast Fourier transform (FFT).

The transformed signal is then passed to a feature extract module 314, which extracts one or more features of the transformed signal for use in a biometric process (e.g. biometric enrolment, biometric authentication, on/in ear detection, etc.). For example, the feature extract module 314 may extract the resonant frequency of the user's ear. For example, the feature extract module 314 may extract one or more mel frequency cepstral coefficients. Alternatively, the feature extract module 314 may determine the frequency response of the user's ear at one or more predetermined frequencies, or across one or more ranges of frequencies. To extract such features, the acoustic stimulus generated at the stimulus generator module 303 is also provided to the feature extract module 314, optionally via the Fourier transform module 312, depending on whether the stimulus generator module 303 outputs the acoustic stimulus in the time or frequency domain. In alternative embodiments, instead of receiving the acoustic stimulus generated at the stimulus generator module 303, the feature extract module 314 may receive a signal derived from the transducer 306, such as a current through a coil of the transducer 306 or a measured impedance of a coil of the transducer 306. Such signals may be processed using processing circuitry not shown in FIG. 3, which may include an analogue-to-digital converter (ADC).

The extracted feature(s) are passed to a biometric module 316, which performs a biometric process on them. For example, the biometric module 316 may determine whether the extracted features(s) indicate that the signal received at the microphone 308 contains a reflection from an ear in general, as opposed to open space for example. One or more extracted feature(s) may be compared to corresponding features in a stored ear print 318. The stored ear print 318 may in this instance be a generic ear print representative of the general population. In another example, the biometric module 316 may perform a biometric enrolment, in which the extracted features (or parameters derived therefrom) are stored as part of biometric data which is characteristic of the individual (i.e. as an ear print). The biometric data may be stored within the system 300 or remote from the system 300 (and accessible securely by the biometric module 316). In another example, the biometric module 316 may perform a biometric authentication, and compare the one or more extract features to corresponding features in the stored ear print 318 (or multiple stored ear prints). In this example, the stored ear print 318 may comprise ear prints obtained specifically from authorised users, for example during biometric enrolment. Again, the stored ear print 318 may be stored within the system 300 or remote from the system 300 (and accessible securely by the biometric module 316).

The biometric module 316 generates a biometric result (which may be the successful or unsuccessful generation of an ear print, and/or successful or unsuccessful authentication and/or the successful or unsuccessful detection of an ear for the purposes of on-ear or in-ear detection). The biometric module 316 may then output the result to the control module 302.

The processing circuitry 322 further comprises an interaction detect module 326 configured to detect a user interaction with the personal audio device 202. For example, the user interaction may be an interaction which has associated with it an audio artefact which is audible to the user. The inventors have found that such artefacts can be used to at least partially mask an acoustic stimulus such that the acoustic stimulus can be provided to the transducer with more energy (either louder or broader in bandwidth). As mentioned above, the user interaction may be a physical interaction between the user and the personal audio device 202, such as the user tapping the personal audio device 202 or pressing a button located on the personal audio device 202. The user interaction may be a voice interaction between the user and the personal audio device 202 such as a voice command which may be intended to be picked up at one or more microphones of the personal audio device 202. Such a voice command may be intended to initiate an exchange with a virtual assistant such as Apple® Siri® or Google® Alexa®.

The interaction detect module 326 comprises one or more inputs for receiving data which may indicate a user interaction. In some embodiments, the interaction detect module 326 may receive data from one or more accelerometers 328 enclosed within the personal audio device 202. In some embodiments, the interaction detect module 326 may receive data from one or more buttons or switches 330 positioned on the personal audio device 202. In some embodiments, the interaction detect module 326 may receive data from a voice activity detector (VAD) 332 configured to detect near field voice or whether the user is speaking. In some embodiments, the interaction detect module 326 may receive audio from the microphone 308 or other microphones (not shown) which may be configured to detect audio artefacts associated with user interactions. In some embodiments, the interaction detect module 326 may receive data from a heartbeat sensor 334 configured to detect a heartbeat of the user. For example, the heartbeat sensor 334 may sense the presence and/or magnitude of a blood pulse travelling through an artery of the user, such as the carotid artery. In some embodiments, the heartbeat sensor 334 is a heartrate monitor. In some embodiments, the interaction detect module 326 may receive signals and/or data from the transducer 306 which may also be configured to detect audio artefacts associated with user interactions. For example, when the transducer 306 is not being utilised for generation of sound, current induced by audible artefacts incident at the transducer may be used by the interaction detect module 326 for detection of user interactions. The interaction detect module 326 may receive a signal derived from the transducer 306, such as a current through a coil of the transducer 306 or a measured impedance of a coil of the transducer 306. Such signals may be processed using processing circuitry not shown in FIG. 3, which may include an analogue-to-digital converter (ADC). In some embodiments, the same derived signal may be provided to the feature extract module 314 as described above for feature extraction.

Using a combination of data received from one or more of the one or more accelerometers 328, the one or more buttons 330, the VAD 332, and the microphone 308 or other microphones (not shown), the interaction detect module 326 may make a determination that a user event or interaction having an associated audio artefact has taken place and output a user interaction signal to the control module 302. The interaction detect module 326 may also provide information concerning the detected user interaction to the control module 302. Such information may include properties of the audio artefact associated with the user event, such as but not limited to the peak or average amplitude or frequency response, resonance, duration, attack or decay rate of the audio artefact, and acceleration or force applied to the headset.

The inventors have realised that the actions of chewing or masticating provide an internal audio artefact which may be used to mask an acoustic stimulus applied to the ear of the user. Accordingly, in some embodiments, the interaction detect module 326 may use information from one or more of the VAD 332, the transducer 306 and the one or more microphone 308 or other microphones (not shown) to detect that the user is chewing or masticating and to determine one or more characteristics of audio artefact(s) associated with the chewing or masticating.

The inventors have also found that the heartbeat of the user, particularly after strenuous activity, provides an audio artefact capable of masking sound output from the headset to the user. This audio artefact is particularly loud to a user due to the pulsing of blood through the carotid artery very close to the eardrum of the user. Such an audio artefact may not typically be picked up by microphone(s) located external to the user's ear. Accordingly, this sound is particularly suitable for masking since it does not affect SNR since it is not typically detected by microphones. In view of this, in some embodiments, the interaction detect module 326 may use information from the heartbeat sensor 334 to determine that a user is experiencing an audio artefact associated with their heartbeat. The interaction detect module 326 or the heartbeat sensor 334 may determine one or more characteristics of audio artefact(s) associated with the heartbeat. In some embodiments, the heartbeat sensor 334 may detect a heartrate of the user. Using this information, the interaction detect module 326 may predict the presence of future audio artefacts associated with heartbeat, e.g. when the next pulse will occur through the carotid artery near the eardrum. The heartbeat sensor 334 may provide information to the interaction detect module 326 regarding the magnitude of the heartbeat. The interaction detect module 326 may use this information to determine whether the heartbeat has a sufficient magnitude to provide a suitable audio artefact for masking the acoustic stimulus. The interaction detect module 326 may also use information from the one or more microphone 308 and/or the transducer 306 to detect heartbeat characteristics. Such information may be used in conjunction with information from the heartbeat sensor 334.

It has also been found that the sound of the user's footfall during walking or running may have an associated audio artefact suitable for masking the acoustic stimulus. The interaction detect module 326 may use information received from one or more of the accelerometer 328, the one or more microphone 308 or other microphones, and the transducer 306 to detect footfall and characteristics of audio artefacts associated with footfall. Since footfall tends to be periodic, the interaction detect module 326 may be configured to predict future footfall events.

In response to receiving the user interaction signal, the control module 302 may control the stimulus generator module 303 to output an acoustic stimulus at least partially during the decay envelope of the audio artefact associated with the detected user event or interaction. For example, the control module 302 may modify or adjust the properties of the acoustic stimulus so as to maximise the SNR of the measured response signal, whilst masking the acoustic stimulus in the decay envelope of the audio artefact. The modification may be based on the audio artefact properties received from the interaction detect module 326.

The control module 302 may, for example, control the stimulus generator module 303 to increase the amplitude or level of the stimulus output to the transducer 306 in response to detecting an audio artefact. The amplitude may be increased at one or more frequencies which match those of the audio artefact linked to the user interaction. For example, the control module 302 may add additional content to the acoustic stimulus that is inaudible to the user, such as by using a masking model, thereby increasing the level of the acoustic stimulus. The control module 302 may add harmonic content to the acoustic stimulus, thereby increasing the overall level of the acoustic stimulus. The control module 302 may add content to the acoustic stimulus at inaudible frequencies, thereby increasing the level of the acoustic stimulus.

In some embodiments, the control module 302 may modify the duration of the acoustic stimulus. For example, the control module 302 may increase the duration of the acoustic stimulus whilst ensuring the stimulus falls within the decay envelope of the interaction.

In some embodiments, the control module 302 may set or shift the pitch of the acoustic stimulus such that content of the response signal is better aligned with the user's ear canal resonances. For example, a user's ear canal response may be analysed using a broadband stimulus and data indicative of the stored user's ear canal resonances during enrolment of the user in the biometric system 300.

In some embodiments, the control module 302 may cancel the effect of noise from outside the ear on the response signal of the user's ear to the acoustic stimulus, for example, when it is determined that the user is in a relatively high noise situation. For example, the control module 302 may apply masking noise to the user's ear. The masking noise may be shaped to match a spectral shape of the noise from outside of the ear, i.e. background noise.

In some embodiments, an initial estimate of the ear canal response or a determination that the personal audio device 202 is on or in the ear, based on the response signal received at the microphone 308, may first be ascertained. Then, the control module 302 may control the stimulus generator module 303 to generate an additional acoustic probe signal/stimulus to confirm or strengthen the initial estimate for the purposes of biometric authentication or enrolment. As mentioned above, any modifications may be made to the additional stimulus output from the speaker 306, the original applied stimulus, or both.

In some embodiments, the control module 302 may apply a model that takes into account the effect of spectral and/or temporal auditory masking (due to the audio artefact associated with the user interaction) to extend the frequency content and/or duration of the acoustic stimulus. The control module 302 may use information received from the interaction detect module 326 concerning the user interaction (e.g. peak amplitude/frequency response/attack/release) to update the model to contain a modified set of parameters that take into account the ability of the user to hear audio during and/or shortly after the user interaction.

The interaction detect module 326 may continue to provide information about the user interaction (and associated audio artefact) even while the acoustic stimulus is being applied to the transducer 306. For example, the interaction detect module 326 may monitor its inputs to determine ongoing properties of the audio artefact. The interaction detect module 326 may signal to the control module 302 that the audio artefact is no longer present and, in response, the control module 302 may control the stimulus generator module 303 to cease the acoustic stimulus.

In some embodiments the acoustic stimulus generated at the stimulus generator module 303 may be tones of frequency and amplitude. In other embodiments the stimulus generator 303 may be configurable to apply music to the loudspeaker 306, e.g. normal playback operation, and the feature extract module may be configurable to extract the response or transfer function from whatever signal components the acoustic stimulus contains. In either case, the control module 302 may be configured to adjust the acoustic stimulus in response to signals and information received from the interaction detect module 326 concerning user interaction and audio artefacts, so as to maximise the SNR of the response signal received from the ear at the microphone 308.

In some embodiments the feature extract module 314 may be designed with foreknowledge of the nature of the stimulus, for example knowing the spectrum of the applied stimulus signal, so that the response or transfer function may be appropriately normalised. In other more suitable embodiments the feature extract module 314 may comprise a second input to monitor the stimulus (e.g. playback music, adjusted acoustic stimulus) and hence provide the feature extract module 314 with information about the stimulus signal or its spectrum so that the feature extract module 314 may calculate the transfer function from the acoustic stimulus to measured received signal from the microphone 308 from which it may derive the desired feature parameters. In the latter case, the acoustic stimulus may also pass to the feature extract module 314 via the FFT module 312 (denoted by dotted line in FIG. 3).

Figure 4:
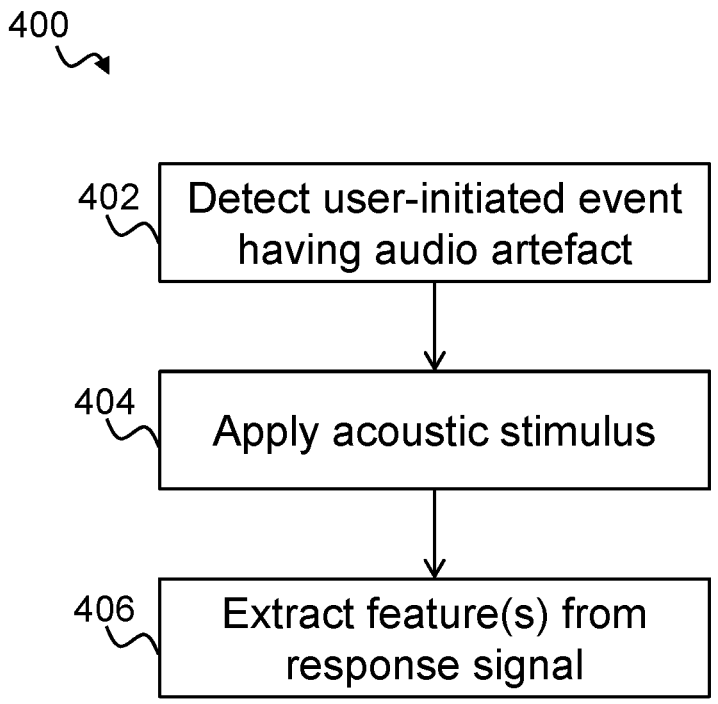
FIG. 4 is a flow diagram of a process according to embodiments of the present disclosure.

FIG. 4 is a flow diagram of a process 400 which may be performed by the system 300 shown in FIG. 3.

At step 402, the biometric system 300 detects a user-initiated event having an associated audio artefact audible to the user in a manner described above with reference to FIG. 3. For example, the user-initiated event may be an interaction of the user with the personal audio device 202. For example, the user-initiated event may be a heartbeat or footfall of the user. For example, the interaction detect module 326 may detect a user interaction based on inputs received from one or more of the microphones 308, the accelerometer 328, the one or more buttons 330, the VAD 332, and/or the heartbeat sensor 334. Alternatively, detecting may comprise predicting that the user-initiated event has occurred based on historic information from previous user-initiated events, each having a historic associated audio artefact. Such historic information may comprise heartbeat data and/or footfall/footstep data. The biometric system 300 may also monitor and/or record the audio artefact.

At step 404, in response to detecting the user-initiated event at step 402, the biometric system 300 generates and applies an acoustic stimulus toward the user's ear using the transducer 306. The stimulus may be directed towards the outer part of the ear (i.e. the auricle), the ear canal, or both. The biometric system 300 is configured to apply the acoustic stimulus at least partially during a decay envelope of the audio artefact associated with the acoustic stimulus as detected at step 402.

At step 406, the biometric system 300 extracts, from a response signal of the user's ear to the acoustic stimulus, for example as received at the microphone 308, one or more features for use in a biometric process (e.g. on/in ear detection, biometric authentication or biometric enrolment). For example, the one or more features may comprise one or more of: the resonant frequency; the frequency response; and one or more mel frequency cepstral coefficients. Biometric enrolment may comprise generating and storing a unique model for the user based on the one or more features. On/in ear detection may comprise comparing the one or more features to a generic model of a human ear. Biometric authentication may comprise comparing the one or more features to a unique model for the user.

Embodiments may be implemented in an electronic, portable and/or battery powered host device such as a smartphone, an audio player, a mobile or cellular phone, a handset. Embodiments may be implemented on one or more integrated circuits provided within such a host device. Embodiments may be implemented in a personal audio device configurable to provide audio playback to a single person, such as a smartphone, a mobile or cellular phone, headphones, earphones, etc. See FIGS. 1*a* to 1*e*. Again, embodiments may be implemented on one or more integrated circuits provided within such a personal audio device. In yet further alternatives, embodiments may be implemented in a combination of a host device and a personal audio device. For example, embodiments may be implemented in one or more integrated circuits provided within the personal audio device, and one or more integrated circuits provided within the host device.

It should be understood—especially by those having ordinary skill in the art with the benefit of this disclosure—that the various operations described herein, particularly in connection with the figures, may be implemented by other circuitry or other hardware components. The order in which each operation of a given method is performed may be changed, and various elements of the systems illustrated herein may be added, reordered, combined, omitted, modified, etc. It is intended that this disclosure embrace all such modifications and changes and, accordingly, the above description should be regarded in an illustrative rather than a restrictive sense.

Similarly, although this disclosure makes reference to specific embodiments, certain modifications and changes can be made to those embodiments without departing from the scope and coverage of this disclosure. Moreover, any benefits, advantages, or solutions to problems that are described herein with regard to specific embodiments are not intended to be construed as a critical, required, or essential feature or element.

Further embodiments and implementations likewise, with the benefit of this disclosure, will be apparent to those having ordinary skill in the art, and such embodiments should be deemed as being encompassed herein. Further, those having ordinary skill in the art will recognize that various equivalent techniques may be applied in lieu of, or in conjunction with, the discussed embodiments, and all such equivalents should be deemed as being encompassed by the present disclosure.

The skilled person will recognise that some aspects of the above-described apparatus and methods, for example the discovery and configuration methods may be embodied as processor control code, for example on a non-volatile carrier medium such as a disk, CD- or DVD-ROM, programmed memory such as read only memory (Firmware), or on a data carrier such as an optical or electrical signal carrier. For many applications embodiments of the invention will be implemented on a DSP (Digital Signal Processor), ASIC (Application Specific Integrated Circuit) or FPGA (Field Programmable Gate Array). Thus the code may comprise conventional program code or microcode or, for example code for setting up or controlling an ASIC or FPGA. The code may also comprise code for dynamically configuring re-configurable apparatus such as re-programmable logic gate arrays. Similarly the code may comprise code for a hardware description language such as Verilog™ or VHDL (Very high speed integrated circuit Hardware Description Language). As the skilled person will appreciate, the code may be distributed between a plurality of coupled components in communication with one another. Where appropriate, the embodiments may also be implemented using code running on a field-(re)programmable analogue array or similar device in order to configure analogue hardware.

Note that as used herein the term module shall be used to refer to a functional unit or block which may be implemented at least partly by dedicated hardware components such as custom defined circuitry and/or at least partly be implemented by one or more software processors or appropriate code running on a suitable general purpose processor or the like. A module may itself comprise other modules or functional units. A module may be provided by multiple components or sub-modules which need not be co-located and could be provided on different integrated circuits and/or running on different processors.

It should be noted that the above-mentioned embodiments illustrate rather than limit the invention, and that those skilled in the art will be able to design many alternative embodiments without departing from the scope of the appended claims or embodiments. The word "comprising" does not exclude the presence of elements or steps other than those listed in a claim or embodiment, "a" or "an" does not exclude a plurality, and a single feature or other unit may fulfil the functions of several units recited in the claims or embodiments. Any reference numerals or labels in the claims or embodiments shall not be construed so as to limit their scope.

As used herein, when two or more elements are referred to as "coupled" to one another, such term indicates that such two or more elements are in electronic communication or mechanical communication, as applicable, whether connected indirectly or directly, with or without intervening elements.

This disclosure encompasses all changes, substitutions, variations, alterations, and modifications to the example embodiments herein that a person having ordinary skill in the art would comprehend. Similarly, where appropriate, the appended claims encompass all changes, substitutions, variations, alterations, and modifications to the example embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative. Accordingly, modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

Although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described above.

Unless otherwise specifically noted, articles depicted in the drawings are not necessarily drawn to scale.

All examples and conditional language recited herein are intended for pedagogical objects to aid the reader in understanding the disclosure and the concepts contributed by the inventor to furthering the art, and are construed as being without limitation to such specifically recited examples and conditions. Although embodiments of the present disclosure have been described in detail, it should be understood that various changes, substitutions, and alterations could be made hereto without departing from the spirit and scope of the disclosure.

Although specific advantages have been enumerated above, various embodiments may include some, none, or all of the enumerated advantages. Additionally, other technical advantages may become readily apparent to one of ordinary skill in the art after review of the foregoing figures and description.

To aid the Patent Office and any readers of any patent issued on this application in interpreting the claims appended hereto, applicants wish to note that they do not intend any of the appended claims or claim elements to invoke 35 U.S.C. § 112(f) unless the words "means for" or "step for" are explicitly used in the particular claim.

The invention claimed is:

1. A method comprising:

monitoring for an event initiated by a user of a personal audio device, the event being a user activity producing an associated audio artefact;

detecting the event;

in response to detecting the event, applying the acoustic stimulus to the user's ear during a masking period in which the acoustic stimulus is masked in the user's hearing by the audio artefact; and extracting, from a response signal of the user's ear to the acoustic stimulus, one or more features for use in a biometric process;

wherein the event comprises one or more of:

(i) a physical interaction with the personal audio device;

(ii) tapping of the personal audio device;

(iii) a voice interaction between the user and the personal audio device;

(iv) a heartbeat of the user;

(v) a footfall of the user; and (vi) a footstep of the user.

2. The method of claim 1, wherein the event is detected using one or more of an accelerometer, a button, a microphone, or a transducer of the personal audio device.

3. The method of claim 1, further comprising generating the acoustic stimulus for application to the user's ear.

4. The method of claim 3, further comprising:

determining one or more properties of the audio artefact, wherein the acoustic stimulus is generated in dependence on the one or more properties of the audio artefact.

5. The method of claim 4, wherein the one or more properties comprises one or more of a frequency response and an amplitude of the audio artefact.

6. The method of claim 4, wherein generating the acoustic stimulus based on the one or more properties of the audio artefact comprises one or more of:

(i) modifying the gain of the acoustic stimulus;

(ii) increasing the duration of the acoustic stimulus;

(iii) applying an additional instance of the acoustic stimulus;

(iv) shifting the pitch of the acoustic stimulus such that content of the response signal is better aligned with one or more resonances of the user's ear;

(v) adding a masking noise to the acoustic stimulus;

(vi) amplifying ambient noise and/or user voice via hear through mode or sidetone path;

(vii) using a masking model to add additional content to the acoustic stimulus that is inaudible to the user;

(viii) adding harmonic content to the acoustic stimulus.

7. The method of claim 1, wherein detecting the event initiated by the user comprise predicting the event based on two or more historic user initiated events, each historic user initiated event having an associated historic audio artefact.

8. The method of claim 1, wherein the masking period at least partially coincides with the audio artefact.

9. The method of claim 1, wherein the biometric process is one of on ear detection, in ear detection, biometric enrolment and biometric authentication.

10. The method of claim 9, wherein biometric enrolment comprises generating and storing a unique model for the user based on the one or more features and wherein biometric authentication comprises comparing the one or more features to a unique model for the user.

11. The method of claim 1, further comprising detecting the response signal at a microphone of the personal audio device.

12. An apparatus, comprising processing circuitry and a non-transitory machine-readable which, when executed by the processing circuitry, cause the apparatus to:

monitor for an event initiated by a user of a personal audio device, the event being a user activity producing an associated audio artefact;

detect the event;

in response to detection of the event, apply an acoustic stimulus to a user's ear using the transducer during a masking period in which the acoustic stimulus is masked in the user's hearing by the audio artefact; and extract, from a response signal of the user's ear to the acoustic stimulus detected by the microphone, one or more features for use in a biometric process;

wherein the event comprises one or more of:

(i) a physical interaction with the personal audio device;

(ii) tapping of the personal audio device;

(iii) a voice interaction between the user and the personal audio device;

(iv) a heartbeat of the user;

(v) a footfall of the user; and (vi) vi a footstep of the user.

13. The apparatus of claim 12, comprising:

a transducer configured to apply the acoustic stimulus; and a microphone configured to detect the response signal of the user's ear, wherein the microphone is further configured to detect an error signal for use in an active noise cancellation system.

14. The apparatus of claim 12, comprising:

a transducer configured to:

apply the acoustic stimulus; and detect the response signal of the user's ear.

15. An electronic device, comprising the apparatus of claim 12.

16. A non-transitory machine-readable medium storing instructions which, when executed by one or more processors, cause an electronic apparatus to:

monitor for an event initiated by a user, the event being a user activity producing an associated audio artefact;

detect the event;

in response to detecting the event, applying an acoustic stimulus to the user's ear during a masking period in which the acoustic stimulus is masked in the user's hearing by the audio artefact;

extracting, from a response signal of the user's ear to the acoustic stimulus, one or more features for use in a biometric process;

wherein the event comprises one or more of:

(i) a physical interaction with the personal audio device;

(ii) tapping of the personal audio device;

(iii) a voice interaction between the user and the personal audio device;

(iv) a heartbeat of the user;

(v) a footfall of the user; and (vi) vi a footstep of the user.

* * * * *